United States Patent [19]

Van Hemmen et al.

[11] 4,262,416

[45] Apr. 21, 1981

[54] SHAVING APPARATUS

[75] Inventors: Dirk J. Van Hemmen; Jan Reinink; Jochem J. de Vries, all of Drachten, Netherlands

[73] Assignee: U.S. Philips Corporation, New York, N.Y.

[21] Appl. No.: 946,514

[22] Filed: Sep. 28, 1978

[30] Foreign Application Priority Data

Nov. 28, 1977 [NL] Netherlands ..... 7713049

[51] Int. Cl.[3] ..... B26B 19/14

[52] U.S. Cl. ..... 30/43.6; 30/346.51

[58] Field of Search ..... 30/34.2, 43.4–43.92, 30/346.51; 76/104 R

[56] References Cited

U.S. PATENT DOCUMENTS 3,992,775 11/1976 De Vries ..... 30/34.2

4,038,748 8/1977 Tyler ..... 30/43.6

FOREIGN PATENT DOCUMENTS 7410160 2/1976 Netherlands ..... 76/104 R

*Primary Examiner*—Gary L. Smith

*Attorney, Agent, or Firm*—Thomas A. Briody; William J. Streeter; Rolf E. Schneider

[57] ABSTRACT

A shaving apparatus includes a cutting member substantially constituted by a central body provided at its circumference with cutters connected to the central body by means of connecting arms. For reasons of manufacturing technology and cost the material thickness is desirable minimized. However, limiting factors in this respect are the strength and the rigidity of the cutting member. In the instant construction the strength and the rigidity of the cutting member are increased by having the connecting arms secured to a bent reinforcement rim at the periphery of the central body.

2 Claims, 4 Drawing Figures

SHAVING APPARATUS

This invention relates to a shaving apparatus having a circular shear plate with hair-entrance apertures and a cutting member which is rotatable relative to the shear-plate, which cutting member is substantially constituted by a circular central body which is provided with cutters at its circumference, which cutters are connected to the central body by means of connecting arms.

Such a shaving apparatus is for example known from U.S. Pat. No. 3,992,775. For reasons of manufacturing technology and cost the material thickness of the cutting member is desirably minimized. However, limiting factors in this respect are the strength and the rigidity of the cutting member.

It is an object of the present invention to provide a shaving apparatus of the indicated type, the strength and the rigidity of the cutting member being increased in comparison with those of the known construction and the invention concerns a construction which is characterized in that the connecting arms adjoin a bent reinforcement rim at the periphery of the central body.

A preferred embodiment is characterized in that each connecting arm adjoins the reinforcement rim by means of a substantially rectangular part of the connecting arm.

An extra rigid construction is obtained with an embodiment which is characterized in that the reinforcement rim adjoins an annular portion of the central body, which annular portion changes into a central portion which has been pressed out of the plane of the annular portion.

A special embodiment is characterized in that the reinforcement rim has a conical shape.

The invention is also embodied by a cutting member as employed in a shaving apparatus as defined in the foregoing.

The invention will now be described in detail in connection with the accompanying drawings, in which.

Figure 1:
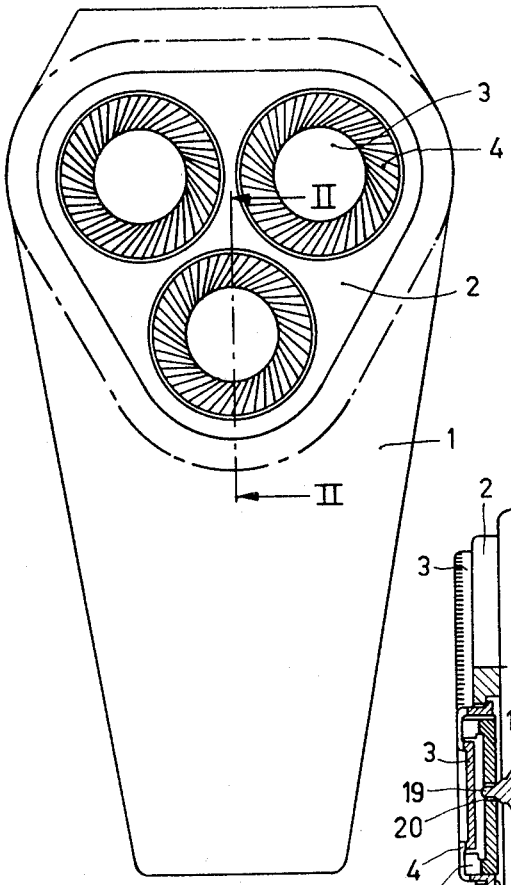
FIG. 1 shows an elevation of a shaving apparatus having three shear plates.
Figure 2:
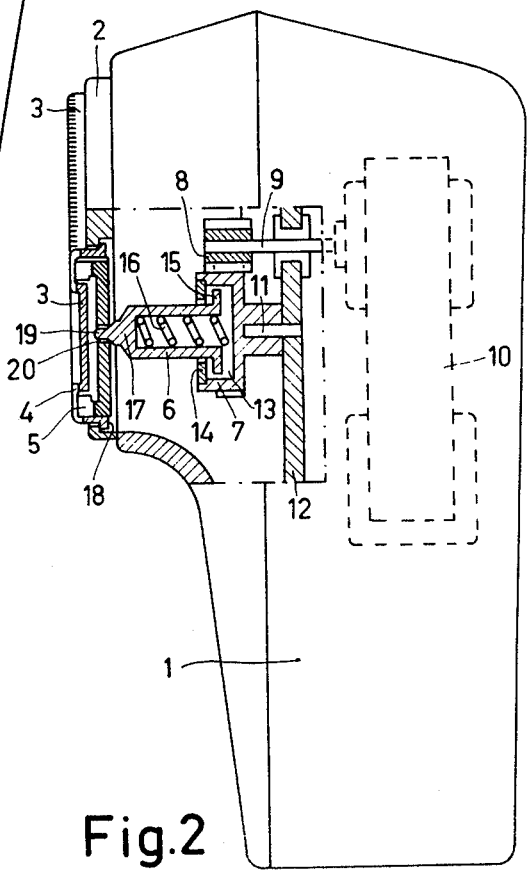
FIG. 2 shows the shaving apparatus of FIG. 1 in side view and partly in a cross-section taken on the line II—II in FIG. 1.

The shaving apparatus in accordance with FIGS. 1 and 2 comprises a housing 1, of which a part takes the form of a shear plate holder 2 for three shear plates 3. The shear plates 3 have hair-entrance apertures 4.

As shown in the partial cross-section of FIG. 2 a cutting member 5 is situated on the inner side of a shear plate 3. This cutting member 5, which for clarity is shown only schematically in FIG. 2, is shown in detail and on an enlarged scale in FIGS. 3 and 4.

The cutting member 5 is coupled to the electric motor 10 by means of the hollow spindle 6 (FIG. 2), the gear wheels 7 and 8, and the spindle 9, so that the cutting member is rotatable relative to the associated shear plate 3. The gear wheel 7 is rotatably journalled on a pin 11 which is mounted in a mounting plate 12. The gear wheel 7 has a recess 13 which is closed by a cover plate 14. This recess accommodates the flange 15 at the end of the hollow spindle 6. By giving the flange 15 a non-round, for example square, shape and by giving the recess 13 a corresponding cross-section, a coupling is obtained for the transmission of the rotary movement from the gear wheel 7 to the spindle 6. The spring 16 which for its greater part is situated in the hollow spindle 6 and which is tensioned between the hollow spindle 6 and the gear wheel 7 exerts a force on the spindle 6 in the direction of the cutting member 5. As the cylindrical portion 17 of the spindle 6 bears against the cutting member 5 this force is exerted on the cutting member and via the cutting member on the shear plate 3, so that the shear plate is pressed against the shear-plate holder 2 along the flanged edge 18. Owing to external forces, as for example those that may occur during use of the shaving apparatus, the shear plate 3 together with the cutting member 5 and the spindle 6 can be pressed inwards against the action of the spring 16.

The coupling for the transmission of rotary movement between the spindle 6 and the cutting member 5 is obtained in that the spindle 6 is provided with an end 19 of substantially rectangular cross-section. This end 19 engages with a corresponding coupling opening 20 in the cutting member 5.

The coupling to the electric motor 10 as described in the foregoing is identical for the three cutting members of the apparatus in accordance with FIGS. 1 and 2, the three gear wheels being in engagement with the single centrally disposed gear wheel 8 on the motor spindle 9.

Figure 4:
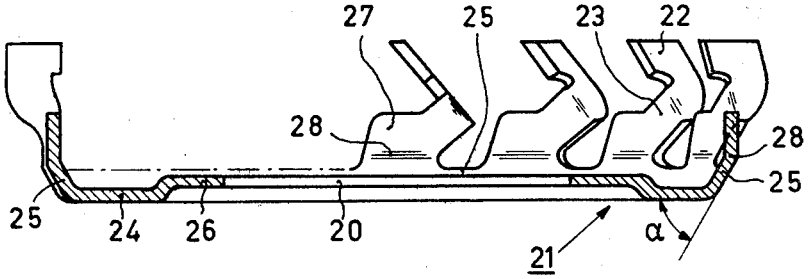
FIG. 4 shows a cross-section taken on the line IV—IV in FIG. 3.
Figure 3:
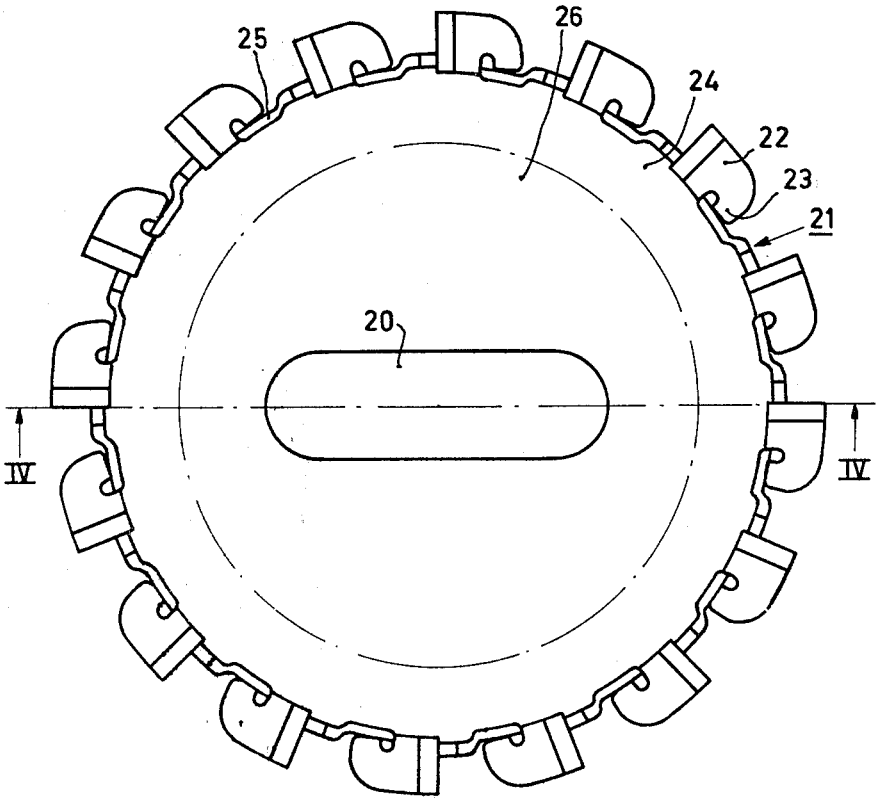
FIG. 3 shows a plan view on an enlarged scale of a cutting member.

The cutting member 5 as shown in FIGS. 3 and 4 comprises a central body 21 in which the coupling opening 20 is formed. The cutting member is provided with cutters 22 which are respectively connected to the central body 21 by means of the connecting arms 23. The assembly is for example manufactured from an originally flat sheet material.

The central body 21 comprises an annular portion 24, a peripheral bent reinforcement rim 25, which adjoins the annular portion, and a central portion 26 which has been pressed out of the plane of the annular portion and merges thereinto. The connecting arms 23 which project from the reinforcement rim 25, can now be shorter, so that the strength and the rigidity of the connecting arms are increased. Owing to the reinforcement rim 25 and the cup-shaped central portion 26, the rigidity of the central body is also increased substantially. It has been found that instead of sheet material having a thickness of 0.8 mm which was used for the manufacture of the known cutting members, sheet material having a thickness of 0.3 mm may be used for the embodiment described in the foregoing.

Each connecting arm 23 adjoins the central body 21 with a substantially rectangular portion 27. The connecting arm 23 is bent relative to the reinforcement rim 25 along a bending line 28 which passes through said rectangular portion 27. It has been found that bending is thus possible with a higher dimensional accuracy.

The reinforcement rim 25 has a conical shape as is indicated by the acute angle $\alpha$ in FIG. 4. This is especially of advantage when the cutters 22 are provided with lead cutters which are respectively connected to the central body 21 with the aid of resilient arms, because as a result of this, mounting the lead cutters onto the cutting member is simplified and, moreover, more room is thus obtained for the resilient arms.

What is claimed is:

1. A shaving apparatus having a circular shear plate provided with hair-entrance apertures and a cutting member associated with and rotatable relative to the shear plate; said cutting member comprising a circular central body, cutters extending from the circumference of said central body toward the shear plate, a radially outwardly conically shaped bent reinforcement rim at the periphery of the central body, and connecting arms respectively securing said cutters to said central body at the outer edge of said reinforcement rim, the part of each connecting arm adjoining the reinforcement rim being substantially rectangular and having a width greater than that of the remainder of the connecting arm.

2. A shaving apparatus according to claim 1, in which the central body includes an annular portion adjoining the reinforcement rim, and a central portion pressed out of the plane of said annular portion and merging thereinto.

* * * * *